US007761047B2

(12) United States Patent
Uehara et al.

(10) Patent No.: US 7,761,047 B2
(45) Date of Patent: Jul. 20, 2010

(54) IMAGE FORMING APPARATUS AND UNCURLING DEVICE FOR IMAGE FORMING APPARATUS

(75) Inventors: Junji Uehara, Inazawa (JP); Junki Ueyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 646 days.

(21) Appl. No.: 11/616,515

(22) Filed: Dec. 27, 2006

(65) Prior Publication Data

US 2007/0147923 A1 Jun. 28, 2007

(30) Foreign Application Priority Data

Dec. 27, 2005 (JP) ..... 2005-374356

(51) Int. Cl.
*G03G 15/00* (2006.01)

(52) U.S. Cl. ..... 399/406; 399/405

(58) Field of Classification Search ..... 271/109, 271/183; 399/406, 405; *B65H 23/34*
See application file for complete search history.

(56) References Cited

U.S. PATENT DOCUMENTS 6,801,742 B1 * 10/2004 Mochimaru et al. ..... 399/309
2006/0165455 A1 7/2006 Kajita

FOREIGN PATENT DOCUMENTS

JP 7-179258 7/1995

* cited by examiner

*Primary Examiner*—Judy Nguyen
*Assistant Examiner*—Jennifer Simmons
(74) *Attorney, Agent, or Firm*—Banner & Witcoff, Ltd

(57) ABSTRACT

An image forming apparatus includes: a discharge wall including a discharge port that discharges a sheet; a first roller; a second roller, the first roller and the second roller transferring the sheet toward the discharge port; a discharge tray including a stacking plate that receives the sheet discharged from the discharge port; and an uncurling device configured to be detachably mounted on the image forming apparatus, the uncurling device including: a curl correcting unit that corrects a curl of the sheet discharged from the discharge port by curving the sheet; and a pushing member including an elastic member, the pushing member pushing the second roller toward the first roller by an elastic force of the elastic members in a state where the uncurling device is mounted on the image forming apparatus.

8 Claims, 8 Drawing Sheets

IMAGE FORMING APPARATUS AND UNCURLING DEVICE FOR IMAGE FORMING APPARATUS

CROSS-REFERENCE TO THE RELATED APPLICATION(S)

This application is based upon and claims priority from prior Japanese Patent Application No. 2005-374356 filed on Dec. 27, 2005, the entire contents of which are incorporated herein by reference.

TECHNICAL FIELD

Aspects of the present invention relate to an image forming apparatus and a technique for correcting a curl of a sheet.

BACKGROUND

When a transfer route of a sheet is curved in an image forming apparatus, the sheet may be curled when it passes through the curved route. The image forming apparatus of electronic photography is usually provided with a fixing unit for fixing a developer image on the sheet by heating and fusing it. When the sheet passes through the fixing unit, the moisture possibly evaporates from the sheet surface to curl the sheet. If the sheet is discharged while being curled, it may have a deteriorated stackability and may form an obscure image on the sheet.

It is general that the curl is corrected by clamping the sheet between rollers and a plurality of rolls thereby to curve the sheet along the circumferences of the rollers. However, the different sheets have different curling characteristics so that a constant uncurling force cannot possibly uncurl a highly tear-resistant sheet such as a postcard.

As disclosed in JP-A-7-179258, there is a technique, in which the force of a pair of rolls to push the transfer rollers are made so variable to adjust the uncurling force as to cover a plurality of kinds of sheets. By interposing springs between roll holders and movably supported spring seats and by displacing the spring seats by cams, more specifically, the force of the rolls to push the transfer rollers is changed.

SUMMARY

According to JP-A-7-179258, it is necessary to support the spring seats movably for adjusting the uncurling force, and to provide cams for moving the spring seats. These necessities may complicate the configuration of the image forming apparatus body for the sheet uncurling operations of little frequency, and may invite the size enlargement of the image forming apparatus body as the parts are more.

Aspects of the present invention provide an image forming apparatus, which can suppress the complexity and the size enlargement of its body in a configuration capable of adjusting uncurling power of a sheet. According to an aspect of the invention, there is provided an image forming apparatus including: a discharge wall including a discharge port that discharges a sheet; a first roller; a second roller, the first roller and the second roller transferring the sheet toward the discharge port; a discharge tray including a stacking plate that receives the sheet discharged from the discharge port; and an uncurling device configured to be detachably mounted on the image forming apparatus, the uncurling device including: a curl correcting unit that corrects a curl of the sheet discharged from the discharge port by curving the sheet; and a pushing member including an elastic member, the pushing member pushing the second roller toward the first roller by an elastic force of the elastic members in a state where the uncurling device is mounted on the image forming apparatus. According to another aspect of the invention, there is provided an uncurling device configured to be detachably mounted on an image forming apparatus, the uncurling device including: a curl correcting unit that corrects a curl of a sheet discharged from a discharge port of the image forming apparatus by curving the sheet; and a pushing member including an elastic member, the pushing member pushing one roller to the other roller by an elastic force of the elastic member in a state where the uncurling device is mounted on the image forming apparatus, the one and other rollers transferring the sheet toward the discharge port.

DETAILED DESCRIPTION

Aspects of the present invention are described in the following with reference to the accompanying drawings.

First Aspect

Figure 1:
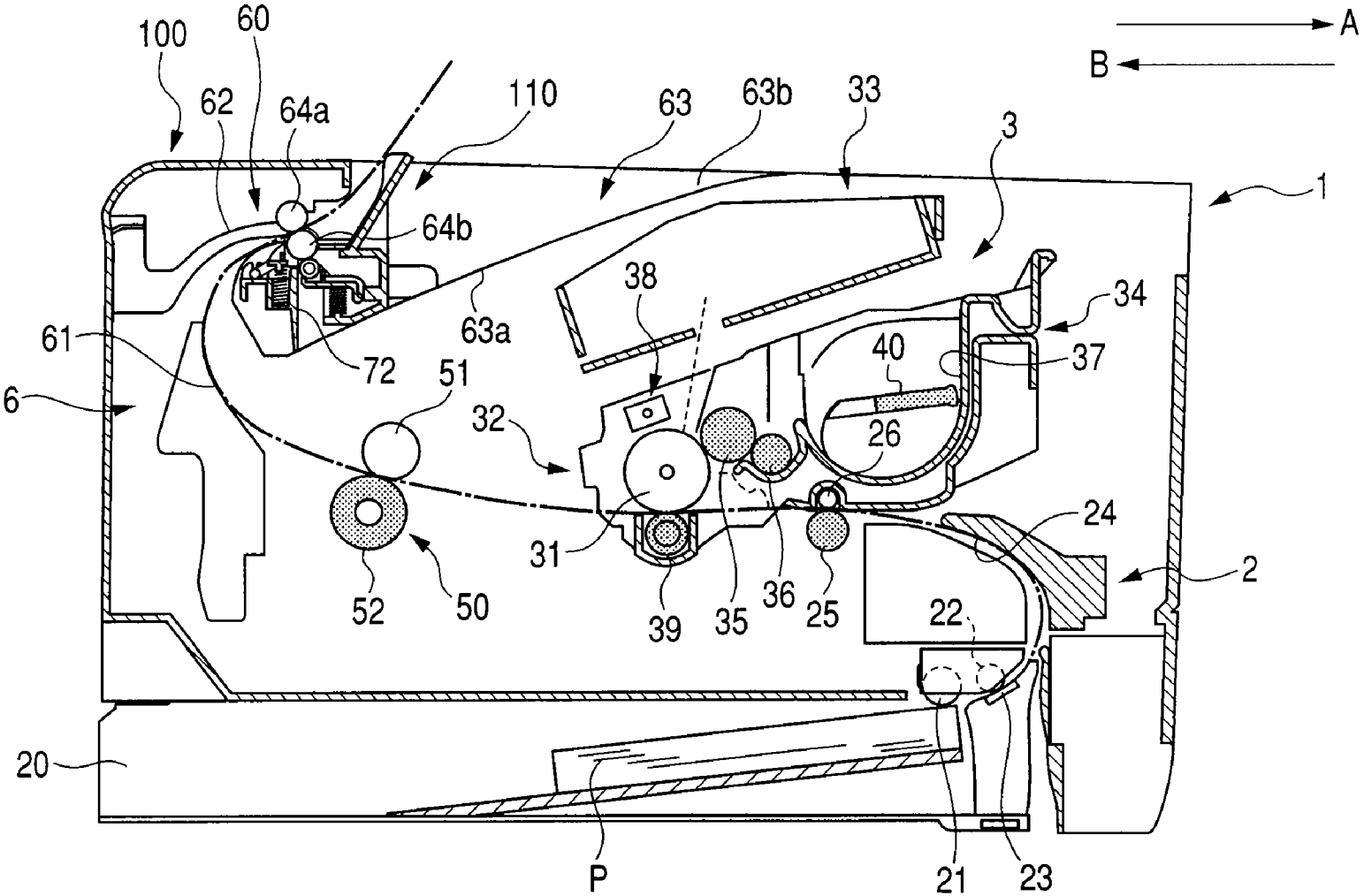
FIG. 1 is a sectional view showing a printer as an image forming apparatus of an aspect of the present invention.

FIG. 1 is a sectional view showing a printer as an image forming apparatus.

As shown in FIG. 1, the printer 1 is provided with a sheet feed unit 2, a process unit 3 acting as an image forming unit, a sheet discharge unit 6 and a casing 100.

The casing 100 covers the sheet feed unit 2 and the process unit 3.

The sheet feed unit 2 is arranged on the lower side in the printer 1 and feeds a sheet P as a recording medium to the process unit 3.

The process unit 3 is arranged above the sheet feed unit 2, and forms an image on the surface of the sheet P fed from the sheet feed unit 2.

The sheet discharge unit 6 discharges the sheet P, which has an image formed on its surface by the process unit 3.

The sheet feed unit 2 is provided with a sheet feed cassette 20, a pickup roller 21, a separating roller 22, a separating pad 23, a guide 24 and a registration roller 25.

The sheet feed cassette 20 is formed into such a box shape having an open top as can be drawn in the direction of arrow A (as will be called the "A-direction") from the printer 1, and can stack many sheets P.

The pickup roller 21 is arranged above the A-direction side end portion of the sheet feed cassette 20, and transfers the sheet P stacked in the sheet feed cassette 20, toward the separating roller 22.

The separating roller 22 and the separating pad 23 are arranged to confront each other. The separating roller 22 and the separating pad 23 clamp and push the sheet P transferred from the pickup roller 21, and transfer the sheet P toward the guide 24 one by one.

The guide 24 guides the sheet P transferred from the separating roller 22, toward the registration roller 25 while bending them substantially into a U-shape.

The registration roller 25 is arranged to confront a registration roller 26, so that it once stops the leading end of the sheet P being guided by the guide 24, and corrects its oblique run. After this, the registration roller 25 transfers the corrected sheet P to a photosensitive drum 31.

The process unit 3 is provided with a drum cartridge 32, a developing cartridge 34, a scanner 33 and a fixing unit 50.

The scanner 33 is disposed in the upper portion of the printer 1, and is provided with a laser emitting device, a mirror, a lens and so on, which are not shown. The scanner 33 irradiates (or exposes) the surface of the photosensitive drum 31 with (or to) a laser beam, as emitted from the laser emitting device and based on predetermined image data, after having been reflected by or transmitted through the mirror and the lens, thereby to form an electrostatic latent image.

The drum cartridge 32 is detachably mounted on the developing cartridge 34 and provided with a developing roller 35 acting as a developer carrier, a feed roller 36 and a developer containing chamber 37 for containing the developer.

The developer containing chamber 37 is provided with an agitator 40, which is rotationally driven for agitating and feeding the developer contained, to the feed roller 36.

The feed roller 36 is disposed adjacent to the developer containing chamber 37, and feeds the developer fed from the agitator 40, to the developing roller 35.

The developing roller 35 is arranged to confront the feed roller 36 has its surface supplied with a positive developing bias. Thus, the developer, as fed from the feed roller 36, is positively charged to a predetermined potential by the sliding contact between the developing roller 35 and the feed roller 36 and by the developing bias.

The positively charged developer sticks, when it is fed from the developing roller 35 to the photosensitive drum 31 having the electrostatic latent image formed on its surface, only to such a portion of the surface of the photosensitive drum 31 as has bee exposed to have a lower potential. Thus, the electrostatic latent image is visualized to a developer image.

The drum cartridge 32 is detachably mounted on the printer 1 and is provided the photosensitive drum 31 arranged below the scanner 33 and acting as a photosensitive element, a transfer roller 39 acting as a transfer unit, a charger 38 and the registration roller 26.

The photosensitive drum 31 is a cylindrical drum having its surface made of a photosensitive resin, and is arranged to confront the developing roller 35.

The charger 38 is a charge of the scorotron type, and is arranged to confront the photosensitive drum 31 above and at a spacing of the same, thereby to charge the surface of the photosensitive drum 31 positively.

The transfer roller 39 is arranged to confront the photosensitive drum 31 and has its surface charged with a transfer bias of a negative potential. The transfer roller 39 clamps the sheet P, while having its surface charged with the transfer bias, between itself and that area of the surface of the photosensitive drum 31, on which the developer image is formed. Thus, the developer image is transferred to the surface of the sheet P.

The fixing unit 50 is provided with a heating roller 51, a pushing roller 52 and a fixing case 54.

The heating roller 51 is equipped with a heater for heating/melting the developer, so that the developer image, as transferred to the sheet P between the photosensitive drum 31 and the transfer roller 39 is thermally fixed on the sheet P between the heating roller 51 and the pushing roller 52.

The pushing roller 52 is pushed toward the heating roller 51.

The sheet P may be curled, while being clamped/transferred by the pushing roller 52 and the heating roller 51, toward the heating roller 51, as the moisture evaporates from the face confronting the heating roller 51.

The discharge unit 6 is provided with a guide 61, a guide 62, a discharge tray 63, a sheet discharge unit 60 and an uncurling device 110.

The guide 61 and the guide 62 guide the sheet P, as transferred from the fixing unit 50, toward the sheet discharge unit while curling the sheet P substantially into a U-shape. The sheet P may be curled as it is curved by the guide 61 and the guide 62. This curling direction is in the same direction as that of the curl made by the heating roller 51.

The discharge unit 60 discharges the sheet P guided by the guide 61 and the guide 62, to the discharge tray 63. The discharge unit 60 is provided with drive rollers 64*a* to be rotationally driven as first rollers, rolls 64*b* to follow as second rollers, and discharge walls 72 having a discharge port 74 (as referred to FIG. 2) formed therein.

The discharge tray 63 is disposed integrally with the casing 100, and stacks the sheets P, which have been clamped/transferred by the drive rollers 64*a* and the rolls 64*b* and discharged from the discharge port 74.

In case the sheet P is a standard paper having a low tear-resistance, the curled degree of the sheet P, as given by the heating roller 51 and the guides 61 and 62, is so relatively low that it does not exert serious influences, even if not especially corrected, upon the stacking in the discharge tray.

In case, however, the sheet P used is a postcard having a higher tear-resistance than that of the standard paper, its curl may deteriorate the stackability in the discharge tray 63.

In order to eliminate the deterioration, according to this aspect, the uncurling device 110 for uncurling the sheet P such as the tear-resistant postcard is detachably mounted at the discharge tray 63 in the body of the printer 1.

Next, the uncurling device 110, the discharge unit 60 and the discharge tray 63 featuring the present invention are described in detail in the following.

Figure 2:
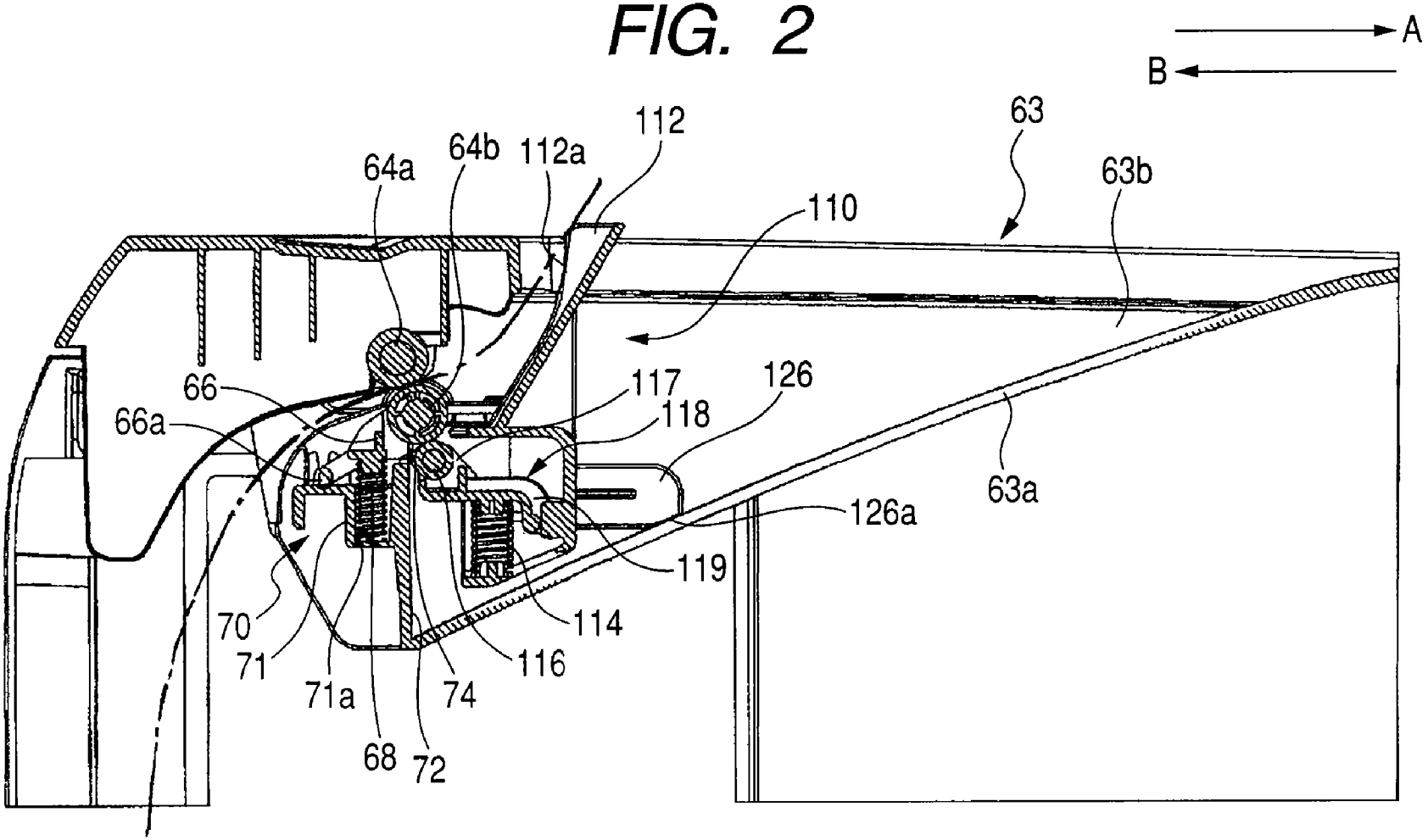
FIG. 2 is an enlarged view of a discharge unit of FIG. 1.
Figure 3:
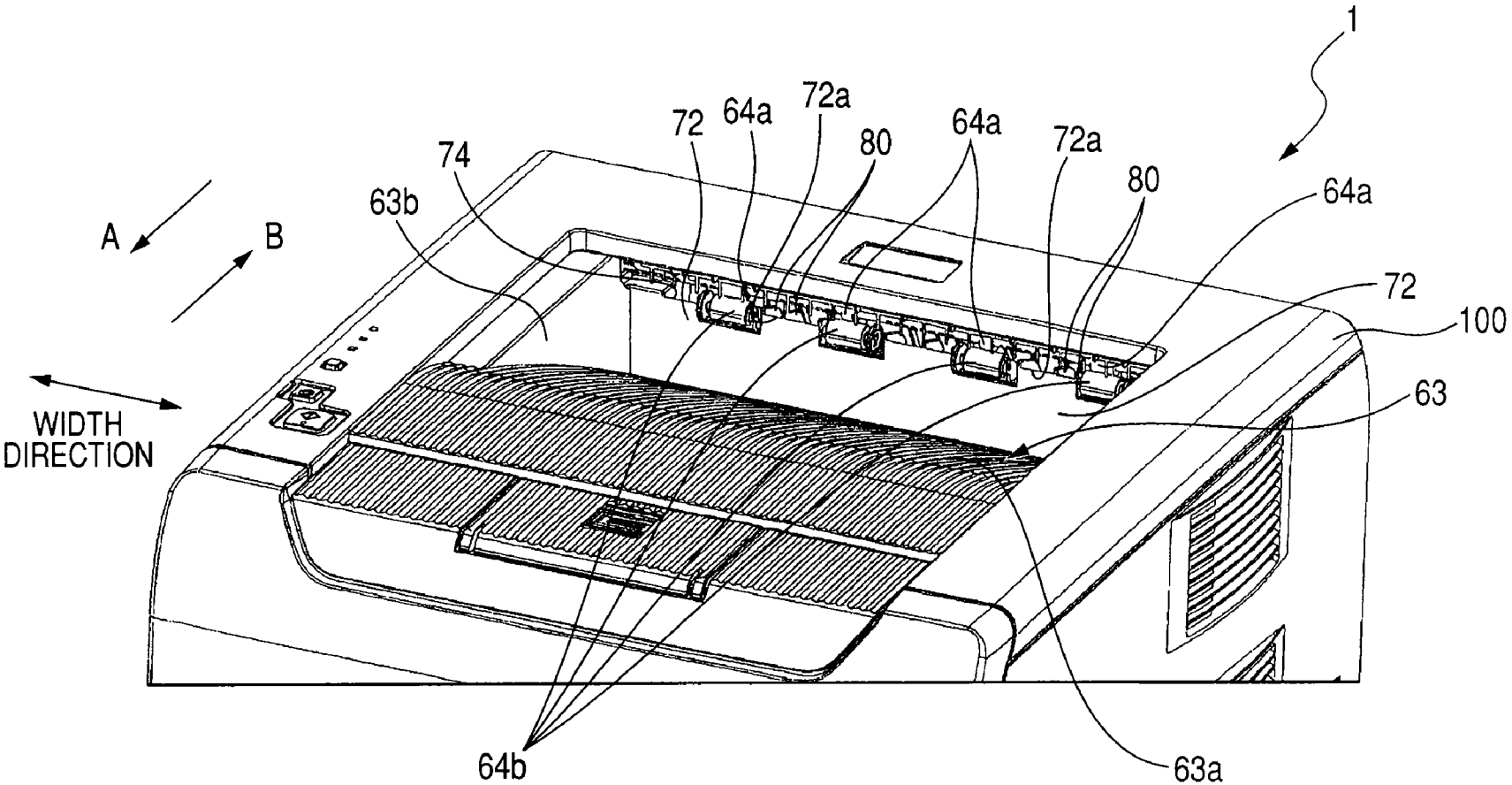
FIG. 3 is a perspective and an enlarged view of the discharge unit, as taken from above with an uncurling device being removed.

FIG. 2 is an enlarged view of the vicinity of the discharge unit 60 of FIG. 1. FIG. 3 is a perspective view of the printer 1, as taken from above with the uncurling device 110 being removed, and an enlarged view of the vicinity of the discharge unit 60.

The discharge tray 63 is provided, as shown in FIG. 2 and FIG. 3, with a stacking plate 63*a* capable of stacking the sheets P discharged from the discharge port 74, and a pair of regulating walls 63*b* erected individually from the two end portions of the widthwise direction (as will be called the widthwise direction) of the stacking plate 63*a* perpendicular to the discharging direction (or the A-direction) of the sheet P and confronting each other. These paired regulating walls 63*b* regulate the widthwise movements of the uncurling device 110. The regulating wall 63*b*, as positioned on the left side when the printer 1 is seen from the side of the A-direction, is shown in FIG. 3, and the regulating wall 63*b* confronting the former regulating wall 63*b* is shown in FIG. 2.

The stacking plate 63*a* is arranged such that its B-direction side end portion is positioned below the discharge port 74, as shown in FIG. 2, and its face is inclined to rise upward as it moves in the direction (or the A-direction) to leave the discharge port 74.

As shown in FIG. 2 and FIG. 3, the discharge unit 60 is provided with four pairs of the drive rollers 64*a* and the rolls 64*b* confronting each other, a roller supporting mechanism 70 for supporting those rolls 64*b* individually, guide ribs 80 extending in the sheet transfer direction for guiding the sheet P to the discharge port, and the discharge walls 72.

The roller supporting mechanism 70 is provided with a roller holder 66, a pedestal 71 and a spring 68.

The roller holder 66 supports the rolls 64*b* rotatably at the A-direction side end portion, and has a pivot 66*a* at the B-direction end portion.

The pedestal 71 supports the pivot rotatably at the B-direction side. By this configuration, the roller holder 66 can be vertically rocked on the A-direction side supporting the rolls 64*b*.

The spring 68 is held at its lower end portion by a recess 71*a* formed in the A-direction side of the pedestal 71 and is fixed at its upper end portion on the lower face of the roller holder 66, and pushes the rolls 64*b* toward the drive rollers 64*a* by urging the A-direction side of the roller holder 66 upward.

The discharge walls 72 are erected upward from the B-direction side end portion of the stacking plate 63*a*, as shown in FIG. 3, thereby to form the discharge port 74 for discharging the sheet P.

The guide ribs 80 are disposed in plurality along the widthwise direction, as shown in FIG. 3, and their upper faces guide the lower face of the sheet P.

The guide ribs 80 are connected at their A-direction side ends by upper end portions 72*a* (as referred to FIG. 6) extending in the widthwise direction of the discharge walls. Here, the connecting ribs in the present invention are formed of the discharge walls 72.

Figure 4:
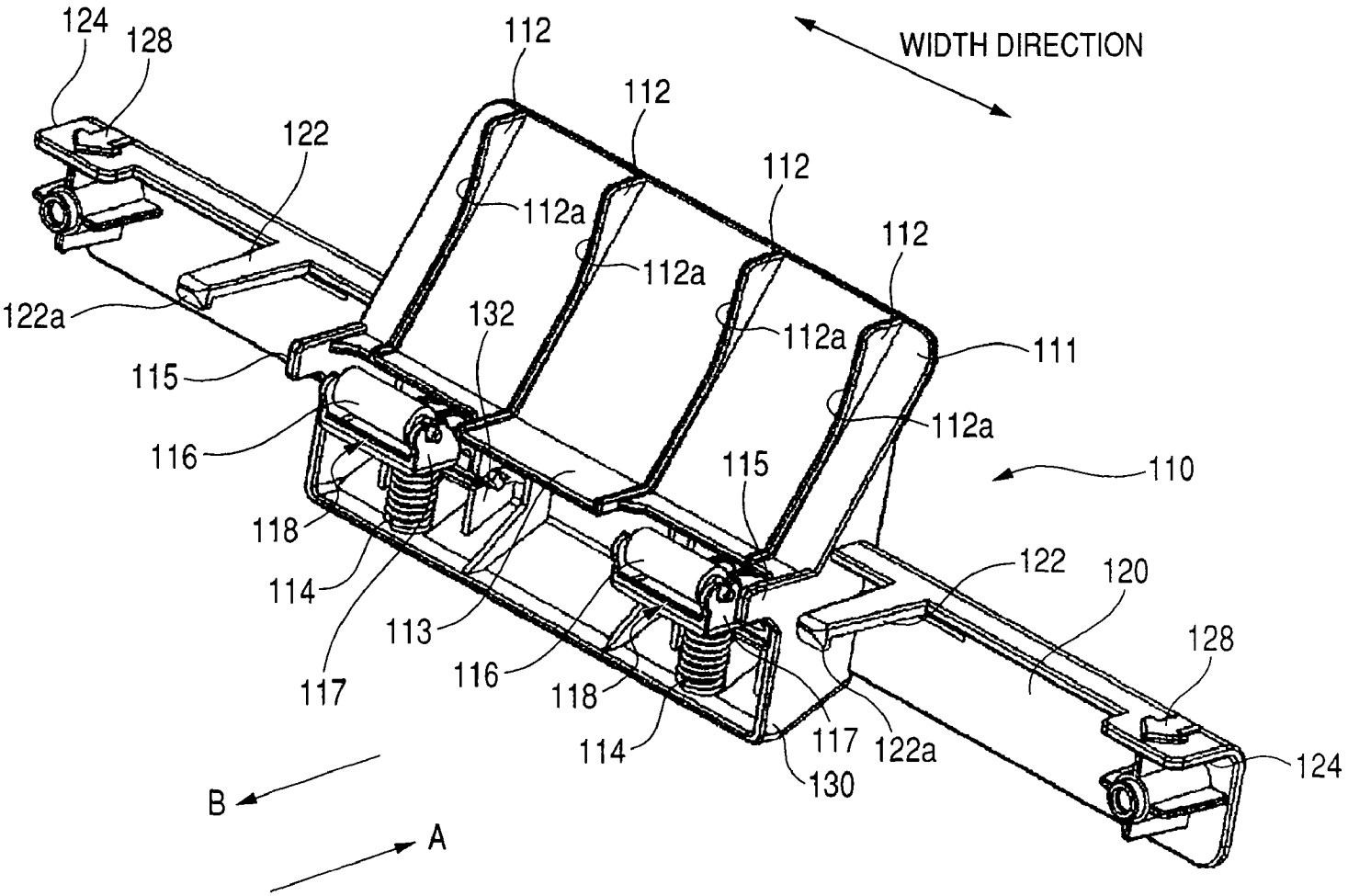
FIG. 4 is a perspective view of the uncurling device as taken from a B-direction side.
Figure 5:
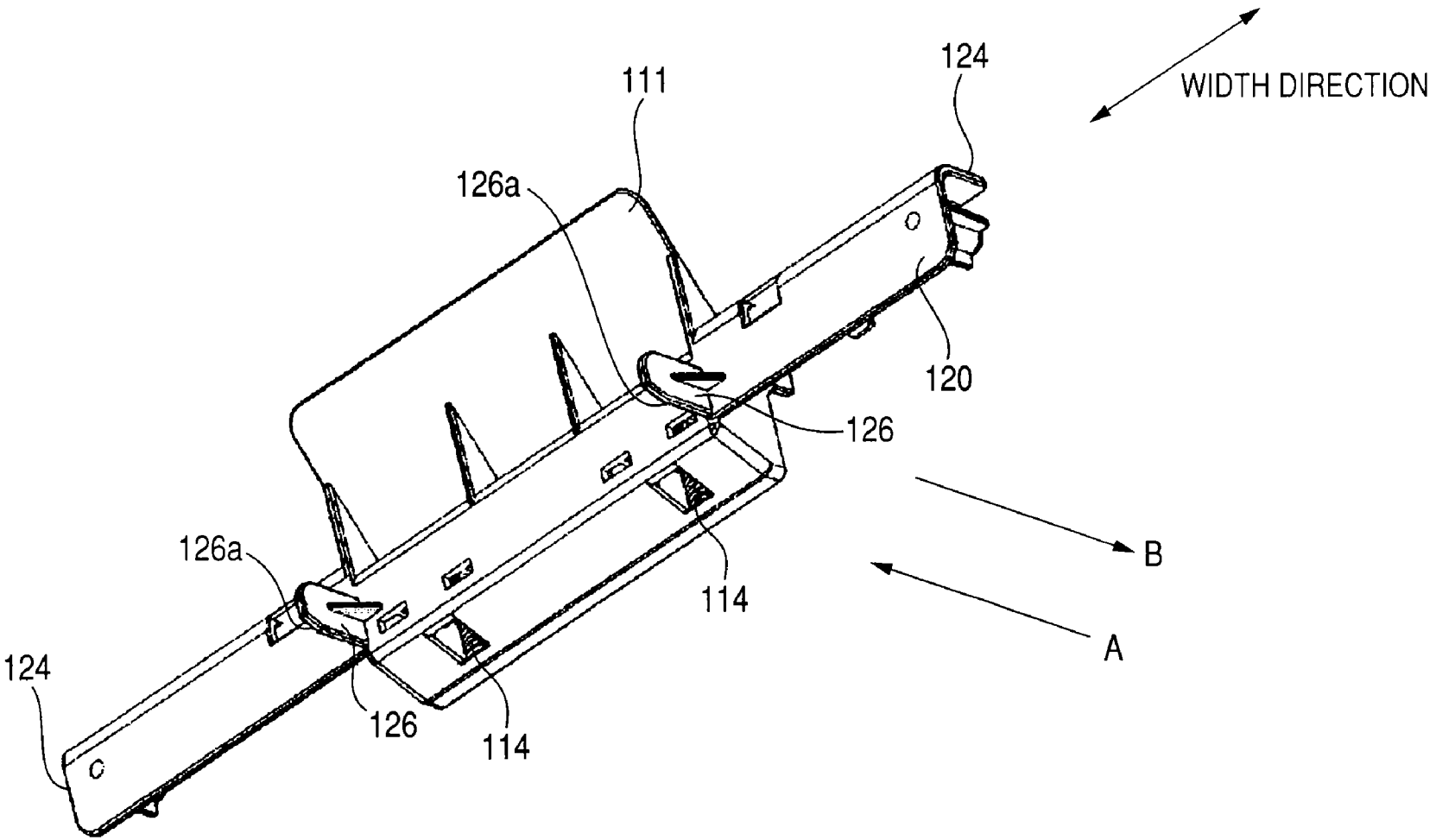
FIG. 5 is a perspective view of the uncurling device as taken from an A-direction side.

FIG. 4 is a perspective view, as taken from the B-direction side, of the uncurling device 110, and FIG. 5 is a perspective view, as taken from the A-direction side, of the uncurling device 110.

The uncurling device 110 is provided, as shown in FIG. 4 and FIG. 5, with: a first base portion 120 extending in the widthwise direction; a second base portion 111 fixed on the upper side at the widthwise central portion of the first base portions 120; a third base portion 130 fixed on the lower side of the second base portions 111; and a pair of pushing members 118 for urging the rollers toward the drive rollers 64*a*.

The first base portion 120 is made slightly smaller in its width than the distance of the paired regulating walls 63*b*, and is provided with a pair of width regulating portions 124 acting as abutting portions, a pair of engaging portions 122, a pair of tray side regulating portions 126, and a pair of arrows 128.

Figure 6:
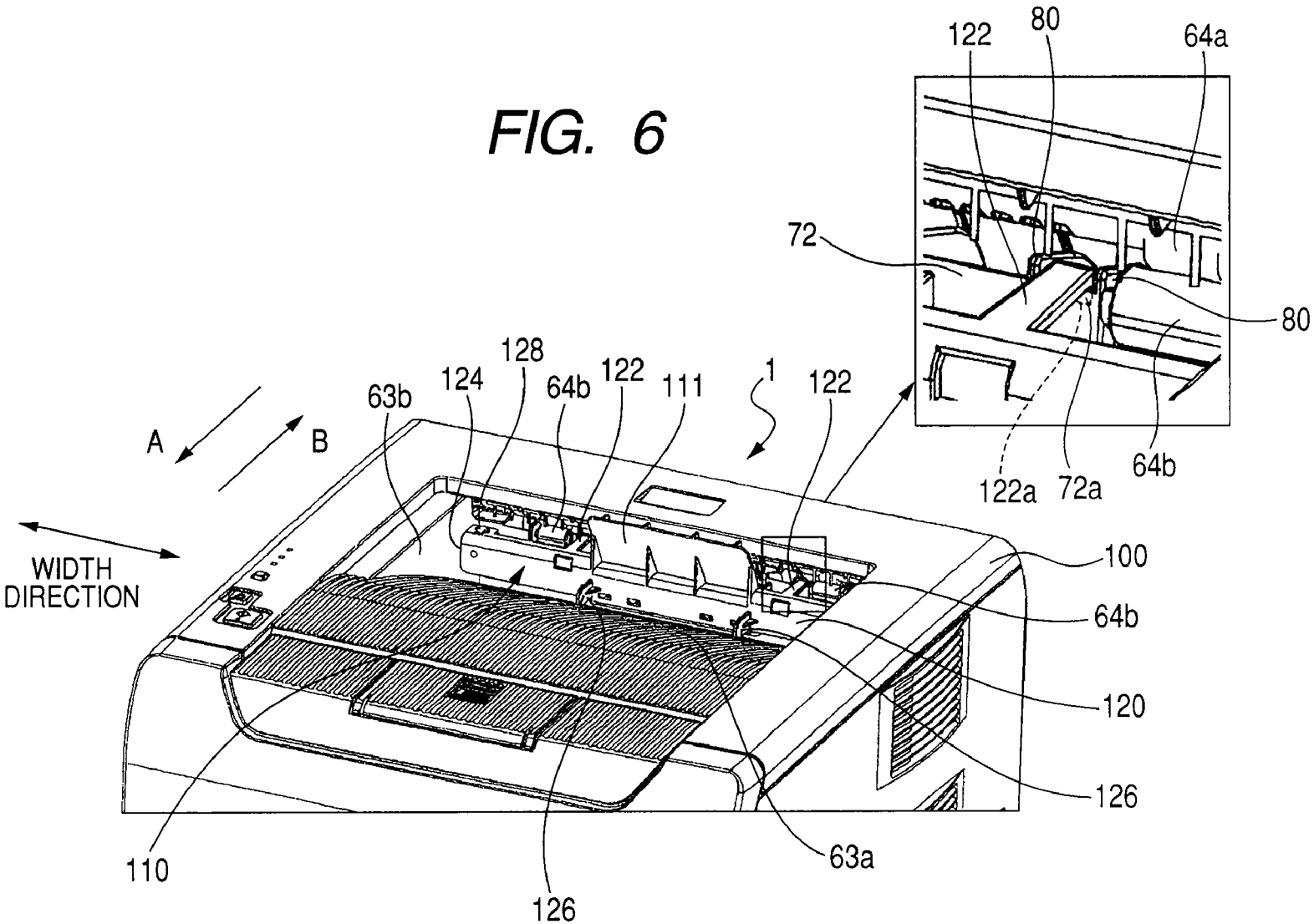
FIG. 6 is a perspective and enlarged view of the discharge unit, as taken from the upper side while having the uncurling device mounted on the printer.

FIG. 6 is a perspective view of the printer 1, as taken from the upper side while having the uncurling device 110 mounted therein, and enlarges the vicinity of the discharge unit 60. In FIG. 6, the area, as enclosed by a larger square, is an enlarged view of the area enclosed by a smaller square.

The paired width regulating portions 124 are formed individually at the two widthwise ends of the first base portion 120, as shown in FIG. 4 and FIG. 5. The uncurling device 110 (or a correcting unit 112) is regulated in its widthwise movement, when mounted in the printer 1, as shown in FIG. 6, by the width regulating portions 124 abutting against the regulating walls 63*b*. In FIG. 6, the width regulating portion 124 and the regulating wall 63*b* on one side are shown, but similar discussions are applied to the width regulating portion 124 and the regulating wall 63*b* on the other side.

The paired engaging portions 122 have pawls 122*a* formed to protrude in the B-direction from the position clamping the second base portions, as shown in FIG. 4, and to protrude downward at the B-direction side (or the discharge port side) end portions.

The pawls 122*a* retain down the upper end portions 72*a* for connecting the guide ribs 80 at the discharge walls 72 while the uncurling device 110 being mounted in the printer, as shown in FIG. 6. With this configuration, the uncurling device 110 (or the correcting unit 112) is regulated, while being mounted in the printer 1, by the retentions between the pawls 122*a* and the upper end portions 72*a*, from moving in the direction away from the discharge port 74, and is also regulated in the widthwise displacement by the abutments of the pawls 122*a* against the paired guide ribs 80 connected to the upper end portions 72*a*.

The paired tray side regulating portions 126 are protruded in the A-direction, as shown in FIG. 5, and are provided at their lower end portions with abutting portions 126*a* to abut against the stacking plate 63*a*. With this configuration, the uncurling device 110 (or the correcting unit 112) is regulated, while being mounted in the printer 1, from moving in the A-direction by the abutting portions 126*a* to abut against the stacking plate 63*a*.

The paired arrows 128 indicate the mounting direction (or the B-direction) of the uncurling device 110 in the discharge tray 63 so that the user can recognize that direction easily.

The second base portion has a width slightly smaller than the width of the regular postcard, and is provided with the four correcting units 112, a protrusion 113 and a discharge port side regulating portion 115.

The correcting units 112 protrude to confront the discharge port 74, and have correcting faces 112*a* acting as inclined faces to abut against the lower face of the sheet P thereby to curve the sheet P upward.

The correcting faces 112*a* are inclined the more upward as they are the closer in the A-direction. With this configuration having the uncurling device 110 mounted in the discharge tray 63, the sheet P, as discharged from the discharge port 74, is curved in the direction opposite to the curling one, so that it is corrected in its curl.

The discharge side regulating portions 115 are formed to protrude toward the discharge port (or in the B-direction) across the protrusion 113, so that they come into abutment against the discharge walls 72 when the uncurling device 110 is mounted in the printer 1. With this configuration, the uncurling device 110 (or the correcting unit 112) is regulated, while being mounted in the printer 1, from moving toward the discharge port 74.

Here, a positioning unit in the present invention is constituted to include the width regulating portions 124, the engaging portions 122, the tray side regulating portions 126, and the discharge port side regulating portions 115.

The third base portion 130 is provided for supporting the pushing members 118, and has supporting portions 132.

The paired pushing members 118 are provided with roller members 116, holders 117, arm members 119 and springs 114, as shown in FIG. 2 and FIG. 4.

The roller members 116 are rotatably supported by the holders 117, and abut upward against the outer circumferences of the rolls 64*b* while the uncurling device 110 being mounted in the printer 1.

The arm member 119 is integrally fixed on the A-direction side of the holder 117, as shown in FIG. 2, and is rotatably supported at its A-direction end portion by the supporting portions 132, as shown in FIG. 4. With this configuration, the holder 117 can rock up and down.

The spring 114 is supported at its lower end on the upper face of the third base portion 130, and is fixed at its upper end on the arm member 119. With this configuration, the roller member 116 is pushed toward the roll 64*b* through the arm member 119 by the elastic force of the spring 114, and pushes the roll 64*b* onto the drive roller 64*a* by that elastic force.

When the poorly tear-resistant sheet P like the standard paper is used, the uncurling device 110 is removed from the discharge tray 63. When the high tear-resistance sheet P such as the postcard is used, the uncurling device 110 is mounted in the discharge tray 63 thereby to correct the curl of the sheet P, as discharged from the discharge port.

The advantages according to the configuration of this aspect are described in the following.

The uncurling force to be applied to the sheet P can be properly adjusted according to the kind of the sheet P by mounting the uncurling device 110 on the body of the printer 1 (or the discharge tray 63) for the sheet P such as the postcard having the high tear-resistance and needing the uncurling force, and by removing the uncurling device 110 from the body of the printer 1 (or the discharge tray 63) for the sheet P such as the standard paper having the low tear-resistance.

Moreover, it is unnecessary to provide the printer body with the mechanism for adjusting the uncurling force. Therefore, it is possible to suppress the complexity and the size enlargement of the printer body.

When the uncurling device 110 is mounted in the discharge tray 63, moreover, the rolls 64*b* are pushed onto the drive rollers 64*a* by the pushing members 118 so that the rolls 64*b* can be prevented from leaving the drive rollers 64*a* when the tear-resistant sheet P passes through the nip positions between the rolls 64*b* and the drive rollers 64*a*. It is, therefore, possible to suppress the instability of the transfer of the sheet P, as might otherwise be caused by the weakened sheet transferring force of the rolls 64*b* and the drive rollers 64*a*.

Moreover, the rolls 64*b* are pushed onto the drive rollers 64*a* by the elastic forces of the springs 114 acting as the elastic members. If these elastic forces are made proper, it is possible to suppress the damage of the sheet P, as might otherwise be caused by the excessively high nip pressure between the rolls 64*b* and the drive rollers 64*a*.

By the abutments between the roller members 116 and the rolls 64*b*, moreover, the elastic forces of the springs 114 can be smoothly transferred to the rolls 64*b*.

The degree of freedom for arrangement of the springs 114 and the rolls 64*b* is raised by the arm members 119.

For the positioning unit for positioning the correcting units in the discharge port, as described hereinbefore, the uncurling device 110 is provided with the width regulating portions 124, the engaging portions 122, the tray width regulating portions 126 and the discharge port side regulating portions 115. Thus, the correcting units 112 and the sheet P to be discharged can be reliably made to abut against each other by positioning the correcting units 112 reliably in the discharge port 74. As a result, the sheet P can be reliably uncurled.

Since the stacking plate 63*a* is inclined, as has been described, the width regulating portions 124 move by their own weights to the discharge port 74, while being regulated (or guided) by the regulating walls 63*b*, when the uncurling device 110 is placed on the stacking plate 63*a*. Thus, it is easy to mount the uncurling device 110 in the discharge tray 63.

When the roller members 116 come into abutment against the rolls 64*b* in the process of mounting the uncurling device 110 in the discharge tray 63, the downward elastic forces are caused to act on the engaging portions 122 through the springs 114 by the reaction of the abutments. When the engaging portions 122 retain the upper end portions 72*a*, therefore, the user can confirm the end of mounting the uncurling device 110 on the discharge tray 63.

Moreover, the retentions of the engaging portions on the upper end portions 72*a* are ensured by those elastic forces.

Second Aspect

A second aspect is described in the following. The second aspect is different from the first aspect in the configuration that the rolls 64*b* are urged toward the drive rollers 64*a*, but the remaining configurations are similar to those of the first aspect. Therefore, the descriptions similar to those of the first aspect are omitted.

Figure 7:
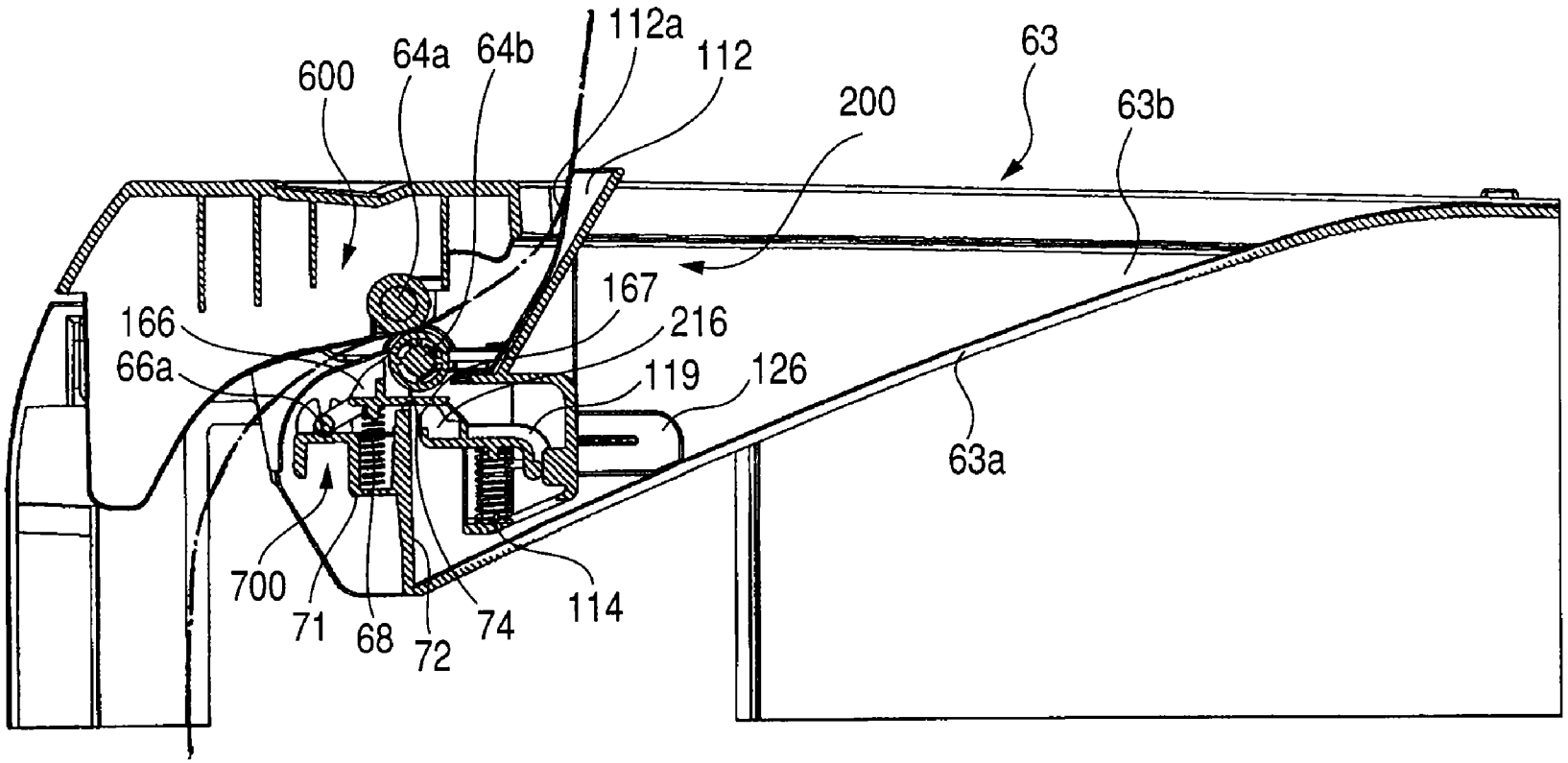
FIG. 7 is an enlarged sectional view showing a discharge unit of still another aspect of the present invention.

FIG. 7 is an enlarged sectional view showing a discharge unit 600 of the second aspect.

A roller holder 166, as disposed in a curl supporting mechanism 700, is provided, as shown in FIG. 7, with a protruding plate 167, which protrudes more in the A-direction (or in the sheet discharging direction) than the discharge port 74 below the rolls 64*b*.

In an uncurling device 200, a wedge type pushing portion 216 is fixed in place of the holder 117 and the roller member 116 in the first aspect on the arm member 119.

The upper end portion of the pushing portion 216 abuts upward against the protruding plate 167 thereby to transfer the elastic force of the spring 114 to the rolls 64*b* and to urge the rolls 64*b* to the drive rollers 64*a*.

With this configuration, the uncurling device 200 does not require the supporting mechanism for supporting the roller member 116 and its roller member 116 rotatably, so that its configuration can be simplified.

Third Aspect

A third aspect is described in the following. The third aspect is different from the first aspect in the configuration that a printer 500 is provided above itself with a scanner 300 as the image reading device, but the remaining configurations are similar to those of the first aspect. Therefore, the descriptions similar to those of the first aspect are omitted.

Figure 8:
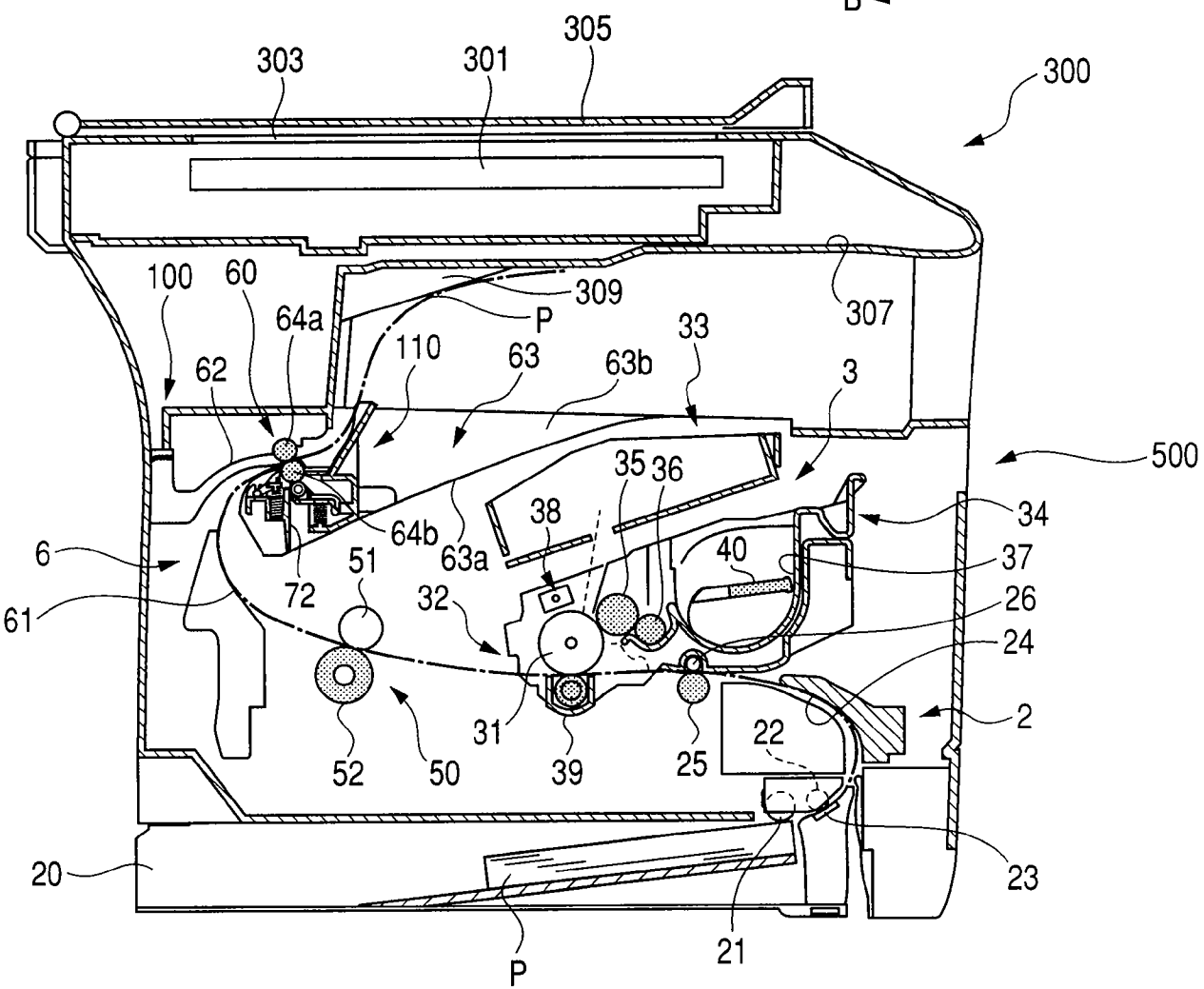
FIG. 8 is a sectional view showing a printer of still another aspect of the present invention.

FIG. 8 is a sectional view of the printer 500.

The scanner 300 is of the flat bed type, as shown in FIG. 8, and is provided with: a platen glass 303 for placing the document; an image sensor 301 for reading the image of the document placed on the platen glass 303; a document cover 305 for covering the platen glass 303; and a bottom plate 307.

The bottom plate 307 has its lower face confronting the discharge tray 63, and is provided at its lower face with FB guide ribs 309.

The FB guide ribs 309 are arranged above the uncurling device 110, and have lower faces inclined the more upward as they go in the A-direction. The sheet P having passed through the uncurling device 110 abuts on the lower faces of the FB guide ribs 309 so that it is guided in the A-direction.

According to this configuration, the leading end of the sheet P having passed through the uncurling device 110 can be prevented from seriously abutting against the bottom plate 307 and from being broken.

A body side uncurling device for correcting the curl of a poorly tear-resistant sheet such as the standard paper may be disposed in the body of the printer 1, although not in the first aspect.

The body side uncurling device may be constituted to push a pair of rolls onto rotationally driven rollers along their transfer direction.

These rolls and rollers may substitute the drive rollers 64*a* and the rolls 64*b* in the first aspect.

What is claimed is:

1. An image forming apparatus comprising:

a discharge wall including a discharge port that discharges a sheet;

a first roller;

a second roller, the first roller and the second roller transferring the sheet toward the discharge port;

a discharge tray including a stacking plate that receives the sheet discharged from the discharge port; and an uncurling device configured to be detachably mounted on the image forming apparatus, the uncurling device including:

a curl correcting unit that corrects a curl of the sheet discharged from the discharge port by curving the sheet; and a pushing member including an elastic member, the pushing member pushing the second roller toward the first roller by an elastic force of the elastic members in a state where the uncurling device is mounted on the image forming apparatus, wherein the pushing member includes a roller member disposed between the elastic member and the second roller, the roller member abutting against an outer circumference of the second roller, to transmit the elastic force to the second roller.

2. The image forming apparatus according to claim 1, wherein the curl correcting unit includes an inclined face that abuts against the sheet discharged from the discharge port, the inclined face curving the sheet in a direction opposite to a curling direction of the sheet.

3. The image forming apparatus according to claim 1, wherein the pushing member includes an arm member movably connecting the roller member and the elastic member, to transmit the elastic force to the roller member.

4. The image forming apparatus according to claim 1, wherein the uncurling device includes a positioning unit that positions the curl correcting unit at the discharge port.

5. The image forming apparatus according to claim 4, wherein:

the discharge wall includes:

a plurality of guide ribs extending in a transfer direction of the sheet for guiding the sheet toward the discharge port; and connecting ribs extending in a direction intersecting the transfer direction and connecting the guide ribs to each other; and the positioning unit includes engaging portions for engaging the connecting ribs between the guide ribs, the engaging portions for regulating the correcting unit from moving in a direction away from the discharge port.

6. The image forming apparatus according to claim 4, wherein:

the discharge tray includes a pair of regulating walls individually erecting from two end portions of the stacking plate in a direction perpendicular to the transfer direction, the pair of regulating walls regulating a movement of the sheet discharged from the discharge port in the direction perpendicular to the transfer direction; and the positioning unit includes a pair of abutting portions respectively abuting against the pair of regulating walls, the pair of abutting portions regulating a movement of the correcting unit in the direction perpendicular to the transfer direction.

7. The image forming apparatus according to claim 1, further comprising:

an image reading device disposed above the discharge tray, the image reading device including:

a sensor for reading an image of a document; and a bottom plate arranged above the stacking plate, wherein the bottom plate includes a guide member disposed on a lower face thereof, the guide member guiding the sheet passed through the uncurling device.

8. An uncurling device configured to be detachably mounted on an image forming apparatus having an image forming apparatus roller for transferring a sheet toward a discharge port, the uncurling device comprising:

a curl correcting unit that corrects a curl of the sheet by curving the sheet; and a pushing member including an elastic member, the pushing member pushing a curl correcting unit roller to the image forming apparatus roller by an elastic force of the elastic member in a state where the uncurling device is mounted on the image forming apparatus, the one curl correcting unit roller and image forming apparatus roller transferring the sheet toward the discharge port, wherein the pushing member includes a roller member disposed between the elastic member and the second roller, the roller member abutting against an outer circumference of the second roller, to transmit the elastic force to the second roller.

* * * * *